US008240178B2

(12) United States Patent
Massard et al.

(10) Patent No.: US 8,240,178 B2
(45) Date of Patent: Aug. 14, 2012

(54) LOCK ASSEMBLY

(75) Inventors: Robert M. Massard, Highland, MI (US); Michael Dussia, Monroe, MI (US); W. Chuck Walker, Angola, IN (US)

(73) Assignee: Redford Lock Company, Inc., Redford, MI (US)

( * ) Notice: Subject to any disclaimer, the term of this patent is extended or adjusted under 35 U.S.C. 154(b) by 701 days.

(21) Appl. No.: 11/724,390

(22) Filed: Mar. 15, 2007

(65) Prior Publication Data

US 2007/0227209 A1 Oct. 4, 2007

Related U.S. Application Data

(60) Provisional application No. 60/782,943, filed on Mar. 16, 2006.

(51) Int. Cl.
*E05B 17/04* (2006.01)

(52) U.S. Cl. ..... 70/379 R; 70/370; 70/371; 70/451

(58) Field of Classification Search ..... 70/370–373, 70/375, 379 R, 380, 449, 379 A, 451
See application file for complete search history.

(56) References Cited

U.S. PATENT DOCUMENTS

| | | | | | |
|---|---|---|---|---|---|
| 3,404,549 | A | * | 10/1968 | Best | 70/370 |
| 4,075,878 | A | * | 2/1978 | Best | 70/371 |
| 4,328,690 | A | * | 5/1982 | Oliver | 70/369 |
| 4,444,033 | A | | 4/1984 | Deckert | |
| 4,926,670 | A | | 5/1990 | Deforrest, Sr. | |
| 5,036,575 | A | | 8/1991 | Campion et al. | |
| 5,193,372 | A | * | 3/1993 | Sieg et al. | 70/369 |
| 5,233,851 | A | * | 8/1993 | Florian | 70/367 |
| 5,884,512 | A | | 3/1999 | Wayne | |
| 5,970,760 | A | * | 10/1999 | Shen | 70/371 |
| 6,109,080 | A | * | 8/2000 | Chen et al. | 70/371 |
| 6,314,774 | B1 | | 11/2001 | Anderson | |
| 6,606,890 | B1 | * | 8/2003 | Widen | 70/369 |
| 6,883,356 | B1 | * | 4/2005 | Wu | 70/379 R |
| 6,889,533 | B2 | | 5/2005 | Fuller | |
| 2005/0011239 | A1 | | 1/2005 | Lurie et al. | |

OTHER PUBLICATIONS

*Notes on SF1C (Best) Interchangeable Core Locks*; Author: Matt Blaze; dated Apr. 21, 2003 (www.crypto.com/photos/misc/sfic).
Rim Parts & Accessories Price List dated Jun. 2, 2003.

(Continued)

*Primary Examiner* — Suzanne Barrett
*Assistant Examiner* — Christopher Boswell
(74) *Attorney, Agent, or Firm* — Howard & Howard Attorneys PLLC

(57) ABSTRACT

The present invention provides for a lock assembly for selectively locking and unlocking a door using a key. The lock assembly includes a housing with a core removably disposed in the housing. A first actuator is coupled to the housing for defining a first lock configuration with a second actuator coupled to the housing independently from the first actuator for defining a second lock configuration. The core includes a keyway for receiving the key and is rotatable within the core between a locked position and an unlocked position. A universal drive member is coupled to the keyway and movable with the keyway between the locked and unlocked positions with the universal drive member interchangeably receiving the first actuator and the second actuator while the keyway remains in the core for interchanging the lock assembly between the first lock configuration and the second lock configuration.

23 Claims, 9 Drawing Sheets

OTHER PUBLICATIONS

Fine Faucets, Trim & Accessories List dated May 26, 2005 (www.chown.com/cgi-bin/lansaweb?PROCFUN+HP1466+HP1466A+HDW+FUNC . . . ).
Multi Lock Parts List dated May 27, 2005 (www.multilock.com/parts).
Mortise Cylinders Price List dated Sep. 20, 2004.
Mortise Parts (Keyed & Turn Knob) dated Sep. 20, 2004.
Ilco Parts List (Cylinders & Plugs) (no date or reference info.).
Medeco Cylinders & Plugs—Rim & Mortise Parts List (no date or reference info.).
Mortise and Rim Cylinders—Best Access Systems Brochure; and the Universal Dummy Cylinder (by Robert Massard & Michael Dussia).

* cited by examiner

LOCK ASSEMBLY

CROSS REFERENCE TO RELATED APPLICATION

This application claims the benefit of U.S. provisional application Ser. No. 60/782,943 filed Mar. 16, 2006.

BACKGROUND OF THE INVENTION

1. Field of the Invention

The present invention relates to a lock assembly for selectively locking and unlocking a door using a key.

2. Description of the Prior Art

The lock assemblies of the prior art are typically used for locking a door or a window. An example of such a configuration for locking a door is shown in U.S. Patent Publication No. 2005/0011239 to Lurie, et al. The lock assembly disclosed in this publication has multiple parts specific to either a first lock configuration or a second lock configuration. Typically, the first lock configuration is commonly referred to as a mortise cylinder and the second lock configuration is commonly referred to as a rim cylinder. The mortise cylinder includes a first actuator and a first drive member coupled to each other such that rotation of the first drive member rotates the first actuator to lock and unlock the door. The rim cylinder includes a second actuator and a second drive member coupled to each other such that rotation of the second drive member rotates the second actuator to lock and unlock the door. Meaning, each of the mortise and rim cylinders require a different drive member to lock and unlock the door.

Another example of a lock assembly is shown in U.S. Pat. No. 4,444,033 to Deckert. The lock assembly disclosed in this patent includes a housing for mounting to a door. The lock assembly includes a drive member integral disposed on a plug for either a first lock configuration or a second lock configuration. Again, the first lock configuration is commonly referred to as a mortise cylinder and the second lock configuration is commonly referred to as a rim cylinder. The mortise cylinder includes a first actuator and the rim cylinder includes a second actuator. The first actuator is coupled to the drive member for the first lock configuration or the second actuator is coupled to the drive member in the second lock configuration independently from the first actuator. In either situation, since the drive member is integral with the plug, the housing must be removed from the door in order to remove the plug from the housing because the actuator coupled to the drive member cannot be pulled through the housing. Meaning, the first actuator or the second actuator must be detached from the drive member before the plug may be removed from the housing.

In addition, the housing defines a plurality of bores for receiving a plurality of pins and a plurality of springs which allow the plug to rotate when a key is inserted in a slot of the plug. However, the pins and springs are separate and distinct component from the plug. Therefore, to remove the pins and springs, the lock assembly must be disassembled which is difficult and time consuming.

Therefore, there remains a need to design a lock assembly having a universal drive member that accommodates both a first lock configuration and a second lock configuration while providing a way to detach the universal drive member from a core to allow the core to be replaced by a second core to lock and unlock the door without disassembling the lock assembly.

SUMMARY OF THE INVENTION AND ADVANTAGES

The present invention provides for a lock assembly having an arm coupled to a latch for selectively locking and unlocking a door using a key. The lock assembly includes a housing for mounting to the door with a core removably disposed in the housing. A first actuator is coupled to the housing for defining a first lock configuration and for engaging the arm to retract the latch to unlock the door. A second actuator is coupled to the housing independently from the first actuator for defining a second lock configuration and for engaging the arm to retract the latch to unlock the door. The core includes a keyway for receiving the key and is rotatable within the core between a locked position and an unlocked position. A universal drive member is coupled to the keyway and movable with the keyway between the locked and unlocked positions with the universal drive member interchangeably receiving the first actuator and the second actuator while the keyway remains in the core for interchanging the lock assembly between the first lock configuration and the second lock configuration.

The present invention therefore provides for a lock assembly having a universal drive member interchangeably receiving a first actuator and a second actuator while a keyway remains in a core for interchanging the lock assembly between a first lock configuration and a second lock configuration. In addition, the universal drive member is easily separable from the core to easily change the core with a second core without disassembling the lock assembly. Additionally, the lock assembly provides a way to reduce inventory by eliminating the need for multiple drive members and multiple housings for each of the first and second lock configurations, which ultimately reduces cost.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
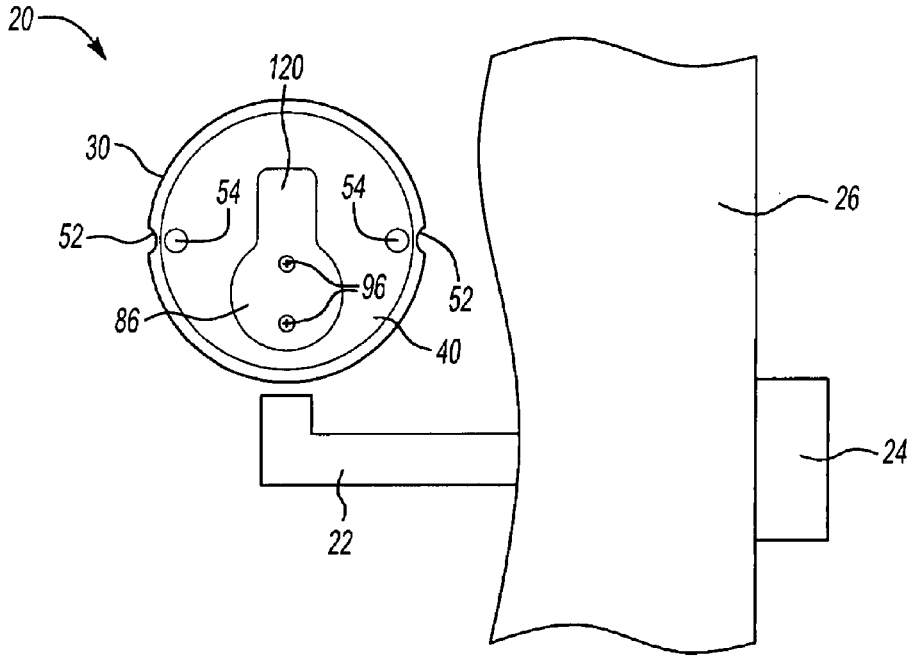
FIG. 1 is a partial fragmented view of a door showing a back view of the lock assembly.

Referring to the Figures, wherein like numerals indicate like or corresponding parts throughout the several views, a lock assembly 20 having an arm 22 coupled to a latch 24 for selectively locking and unlocking a door 26 using a key 28 is generally shown in FIGS. 1, 3-6, and 8-13.

Figure 2:
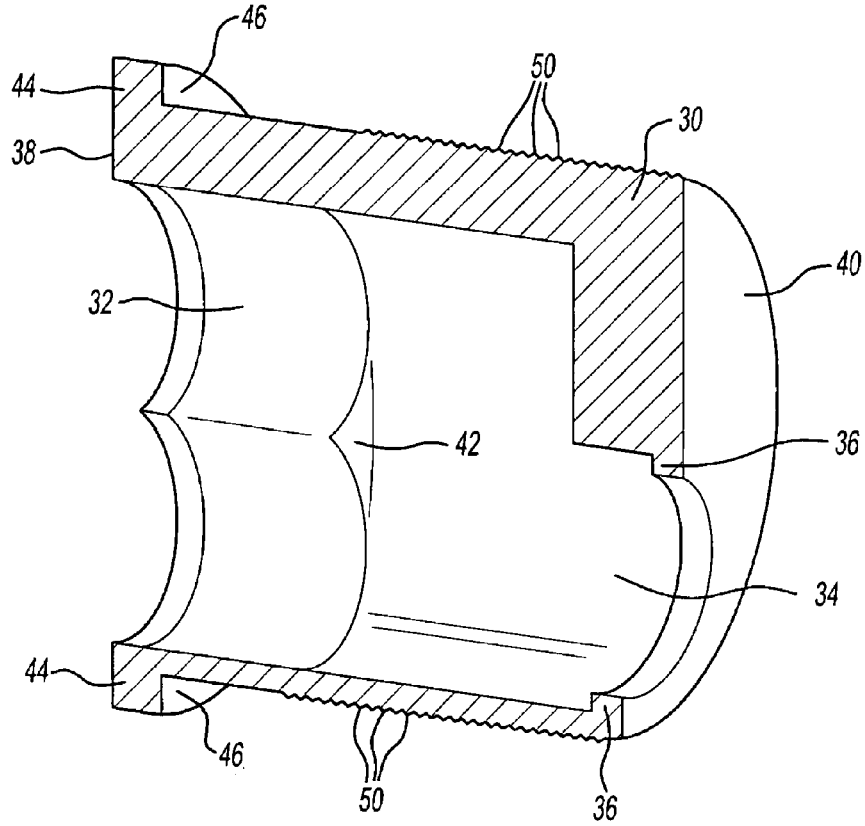
FIG. 2 is a perspective cross-sectional view of a housing.
Figure 3:
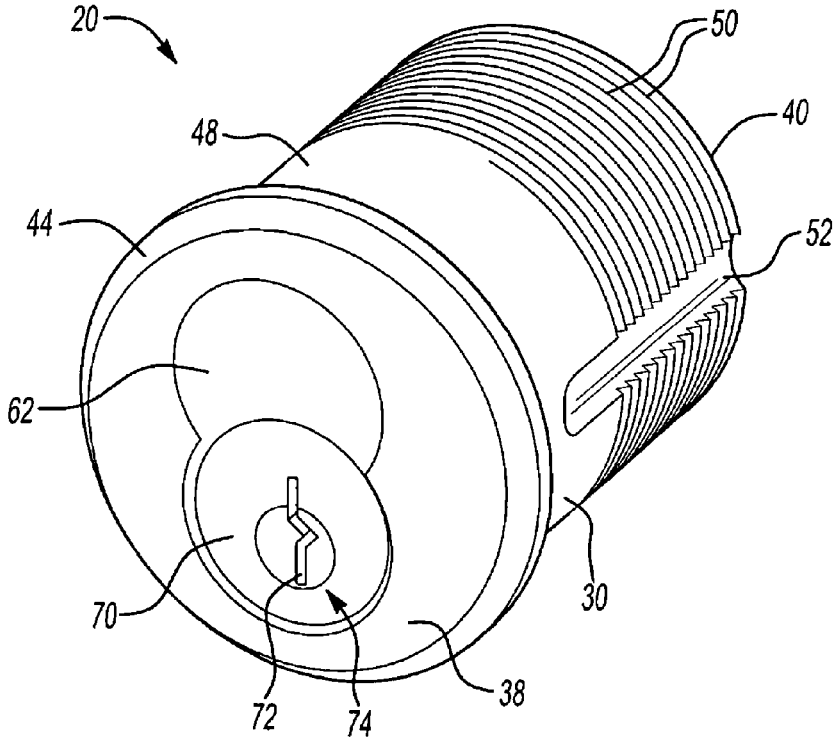
FIG. 3 is a perspective view of the lock assembly with a keyway in a locked position.

Referring to FIGS. 1-3, the lock assembly 20 includes a housing 30 for mounting to the door 26. The housing 30 defines a first chamber 32 and a second chamber 34 adjacent one another with a flange 36 extending into the second chamber 34. More specifically, the housing 30 includes a front side 38 and a back side 40 with the first chamber 32 open to the front side 38 and closed to the back side 40 and the second chamber 34 open to both the front and back sides 38, 40. The housing 30 further includes a tab 42 extending into the first chamber 32 and will be discussed below. A face plate 44 defining a shoulder 46 is disposed on the front side 38 of the housing 30 for abutting the door 26.

Figure 4:
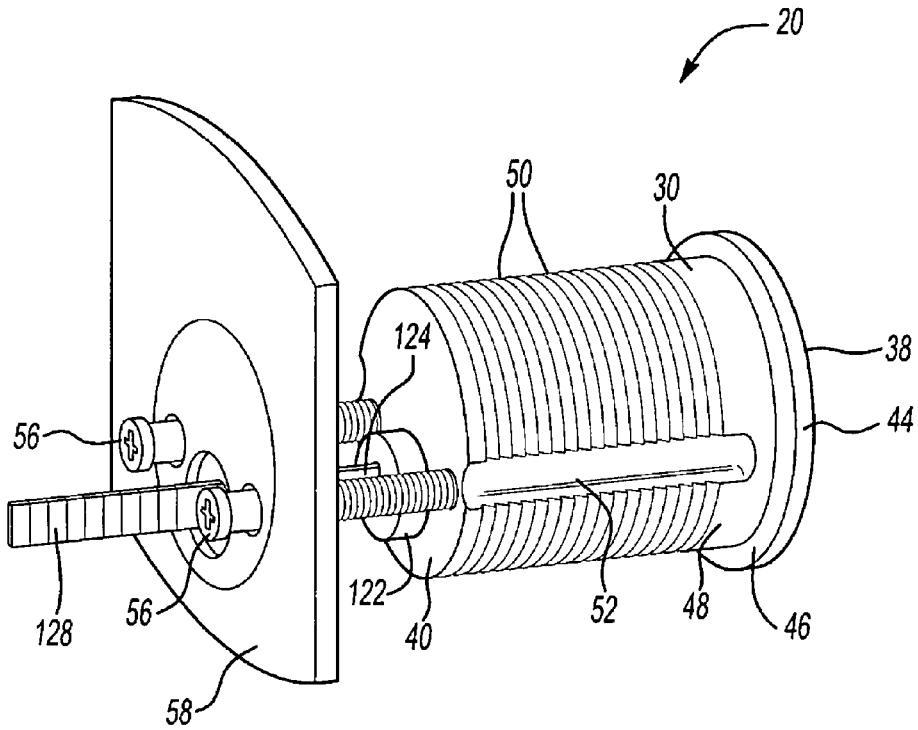
FIG. 4 is a perspective view of the lock assembly having a back plate for mounting the housing to the door in a second lock configuration.
Figure 5:
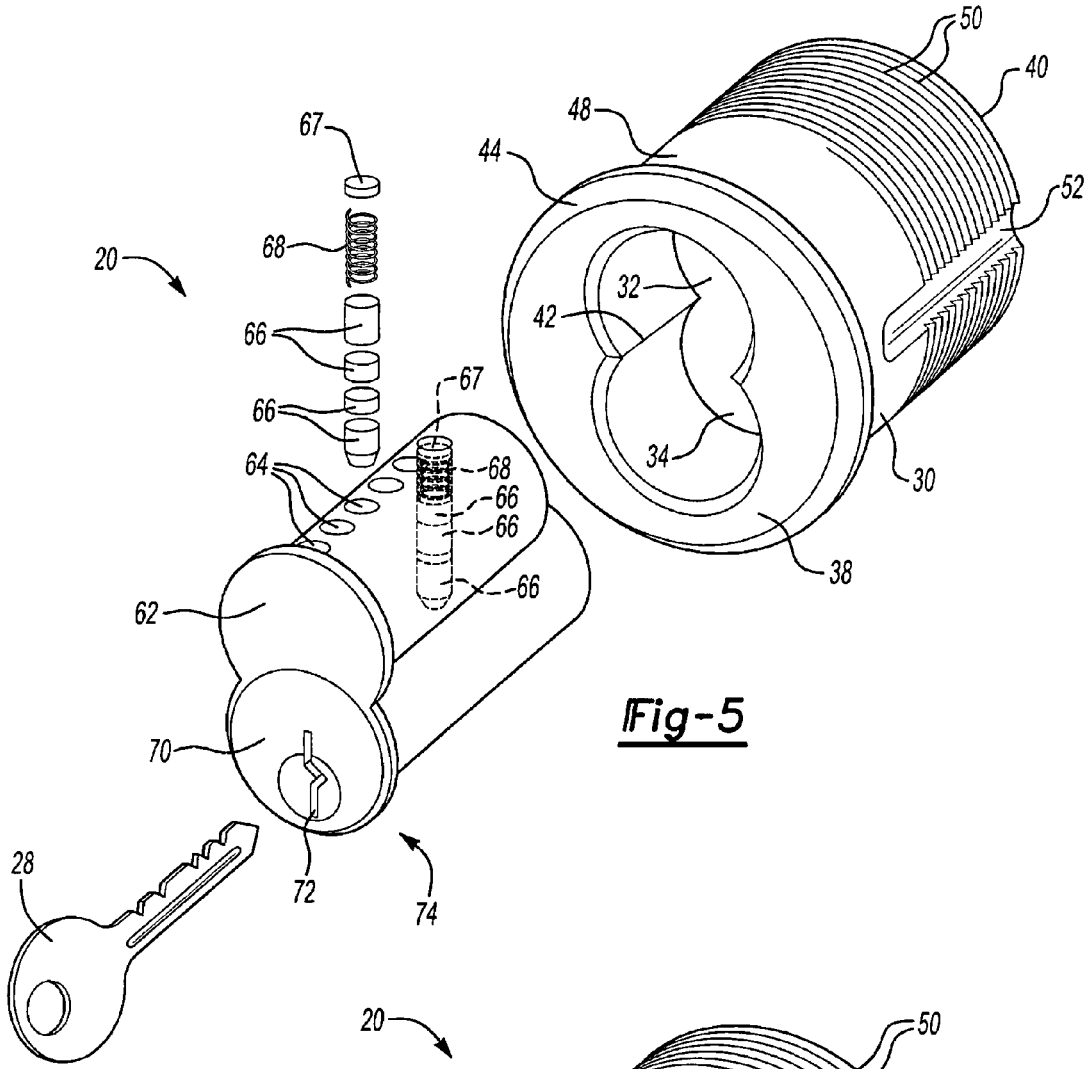
FIG. 5 is a partial exploded view of the lock assembly with a core defining a plurality of bores and having a plurality of pins and a plurality of springs disposed in the bores.
Figure 6:
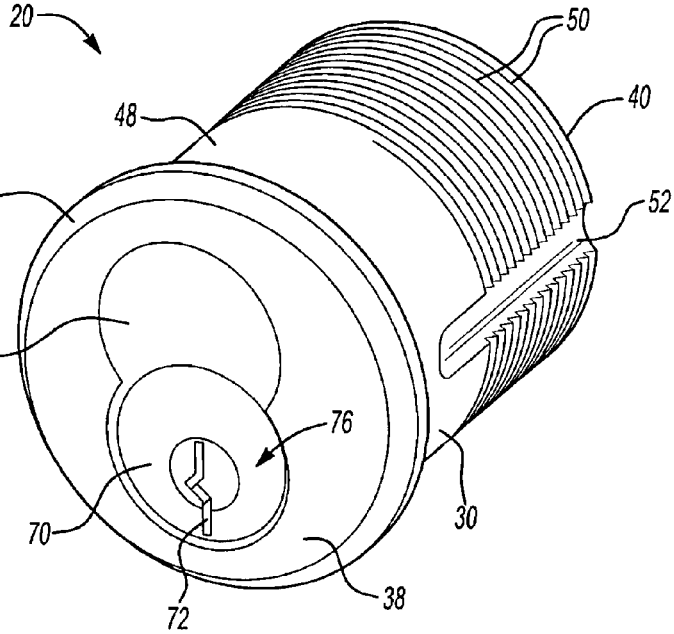
FIG. 6 is a perspective view of the lock assembly with the keyway in an unlocked position.

Also referring to FIG. 4, the housing 30 includes a body portion 48 having a plurality of threads 50 disposed thereon for mounting the housing 30 to the door 26 in a first lock configuration. The body portion 48 defines a plurality of set screw grooves 52, spaced from each other which are known in the art and will not be discussed further. The housing 30 defines a plurality of blind holes 54 disposed on the back side 40 of the housing 30 for receiving a plurality of rim fasteners 56 to secure the housing 30 to the door 26 in a second lock configuration. A back plate 58 is coupled to the housing 30 and defines a plurality of cutouts 60 for receiving the rim fasteners 56 and for securing the housing 30 to the door 26. The first and second lock configurations refer to which actuator is being used and the way the lock assembly 20 is mounted to the door. The first lock configuration is commonly referred to as a mortise cylinder and the second lock configuration is commonly referred to as a rim cylinder. The mortise and rim cylinders will be further explained below.

Referring to FIGS. 3, 5-7, a core 62 is removably disposed in the housing 30. More specifically, the core 62 is disposed in the first chamber 32 and the second chamber 34 of the housing 30 with the first and second chambers 32, 34 of the housing 30 complementary in configuration to the core 62. The core 62 defines a plurality of bores 64 spaced from each other and having a plurality of pins 66 disposed in each of the bores 64 and a plurality of springs 68 with at least one of the springs 68 disposed in each of the bores 64 and abutting at least one of the pins 66. A cap 67 is disposed in the bore to retain the springs 68 and the pins 66 in the bores 64. The pins 66 and the springs 68 are contained in the core 62 which allows a user to easily remove the core 62 and replace the core 62 with a second core (not shown). The second core requires a different key to lock and unlock the door 26. By replacing the core 62 with the second core, the pins 66 and the springs 68 remain contained in the core 62 which prevents the need to disassemble the lock assembly 20 to remove and change the pins 66 to allow another key to unlock the door 26.

Figure 7:
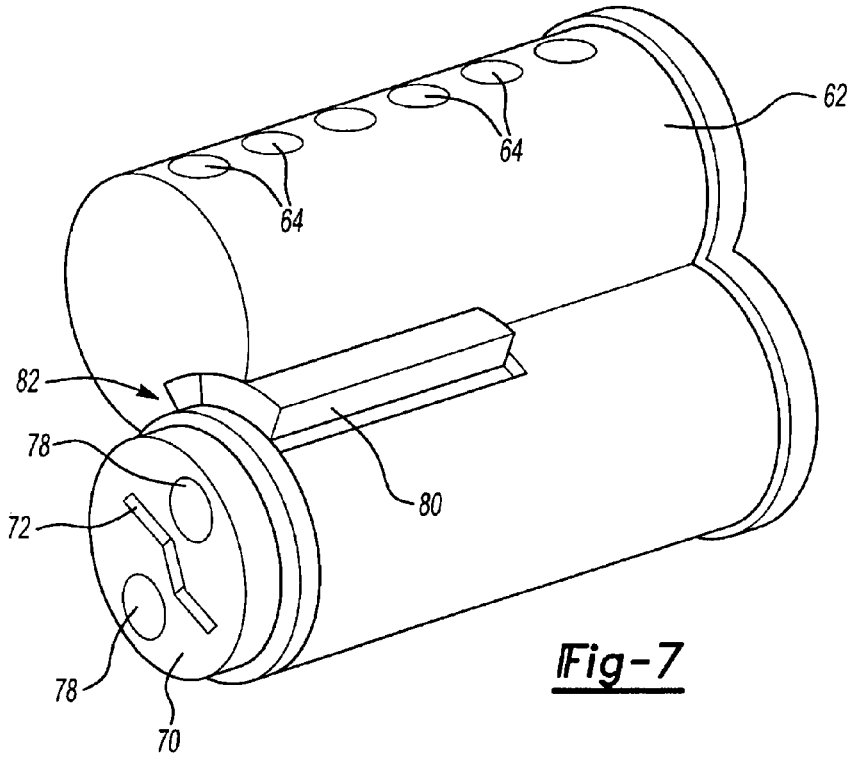
FIG. 7 is a back view of the core having a strip in an engaged position.
Figure 10:
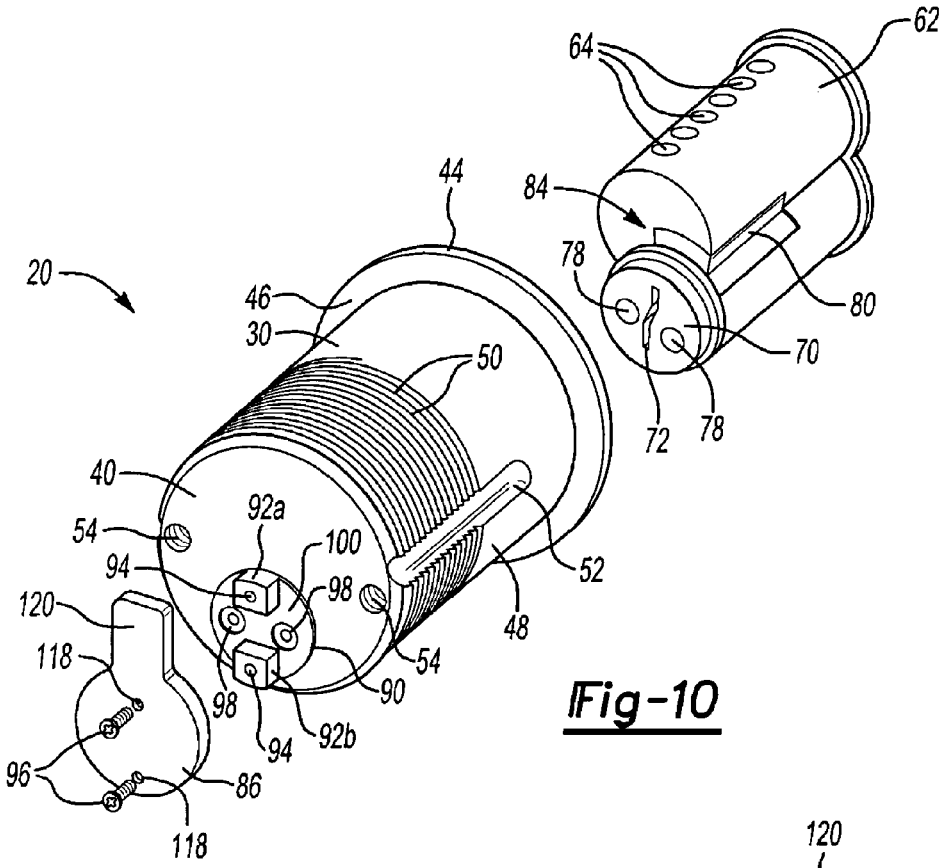
FIG. 10 is a perspective partial exploded back view of the lock assembly in FIG. 8.
Figure 12:
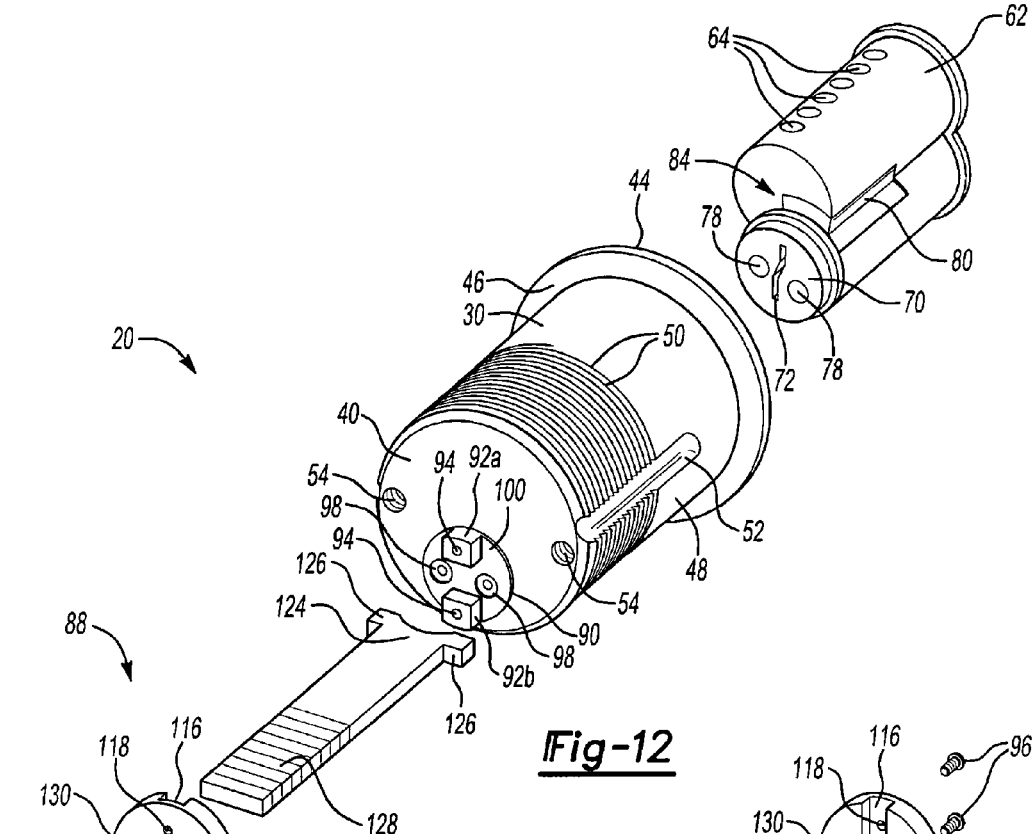
FIG. 12 is a perspective partial exploded back view of the lock assembly of FIG. 9.

The core 62 includes a keyway 70 for receiving the key 28 and is rotatable within the core 62 between a locked position 74 and an unlocked position 76. More specifically, the keyway 70 defines a slot 72 for receiving the key 28 and is rotatable within the core 62 upon insertion of the key 28 within the slot 72. The keyway 70 further defines a plurality of orifices 78 and will be discussed below. As best shown in FIGS. 7, 10 and 12, the core 62 further includes a strip 80 movable between an engaged position 82 and a disengaged position 84 for selectively securing the core 62 in the housing 30. In the engaged position 82, the strip 80 extends out of the core 62 and engages the tab 42 in the housing 30 for preventing the core 62 from being removed from the housing 30. In the disengaged position 84, the strip 80 retracts back into the core 62 and disengages the tab 42 for allowing the core 62 to be removed from the housing 30. A control key (not shown) is used to rotate the strip 80 to the engaged position 82 and to retract the strip 80 to the disengaged position 84. Control keys are known in the art and will not be discussed further.

Figure 8:
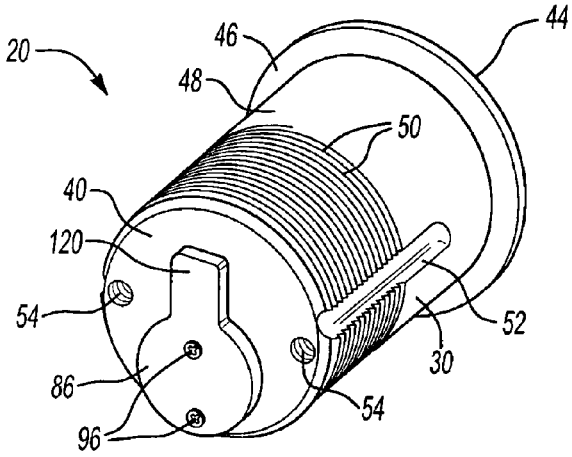
FIG. 8 is an assembled perspective back view of the lock assembly in a first lock configuration.
Figure 9:
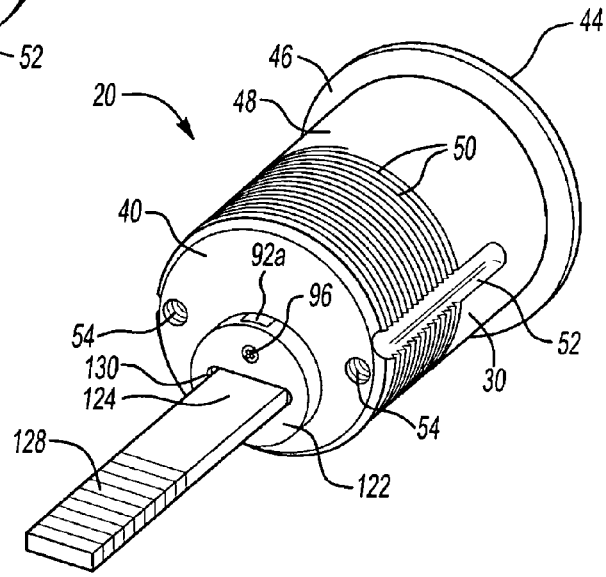
FIG. 9 is an assembled perspective back view of the lock assembly in the second lock configuration.
Figure 11:
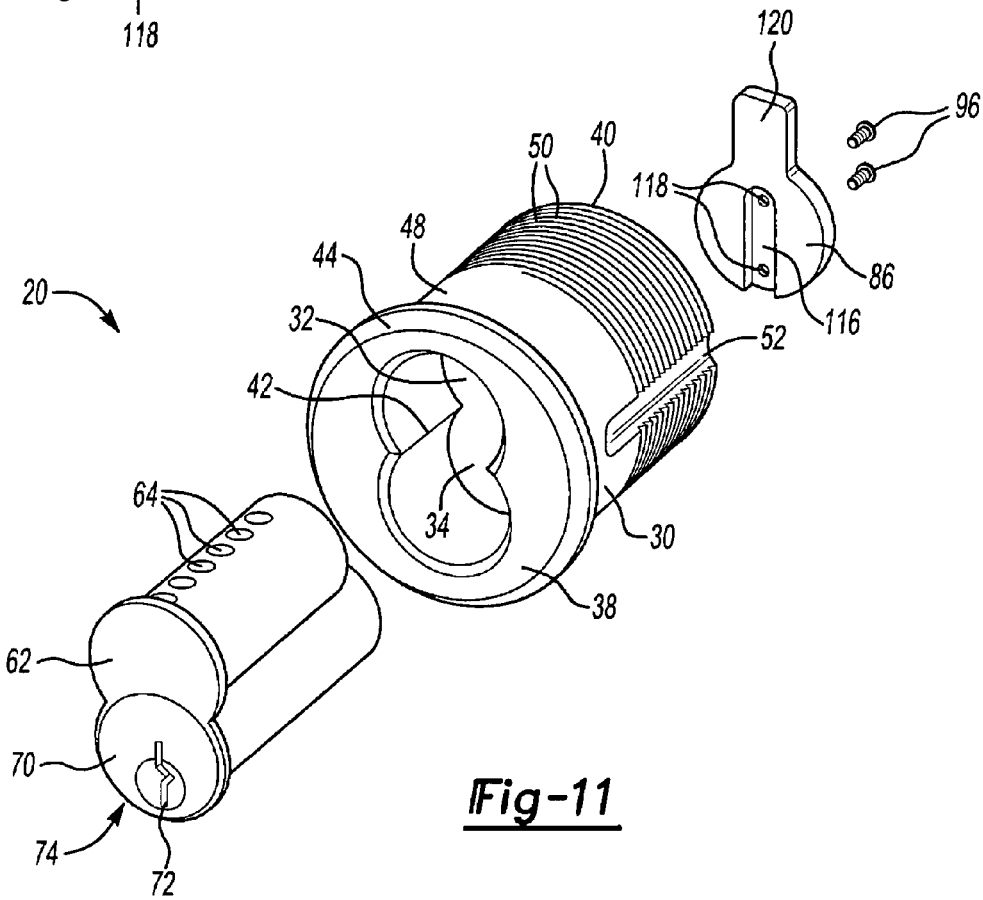
FIG. 11 is a perspective partial exploded front view of the lock assembly in the first lock configuration.
Figure 13:
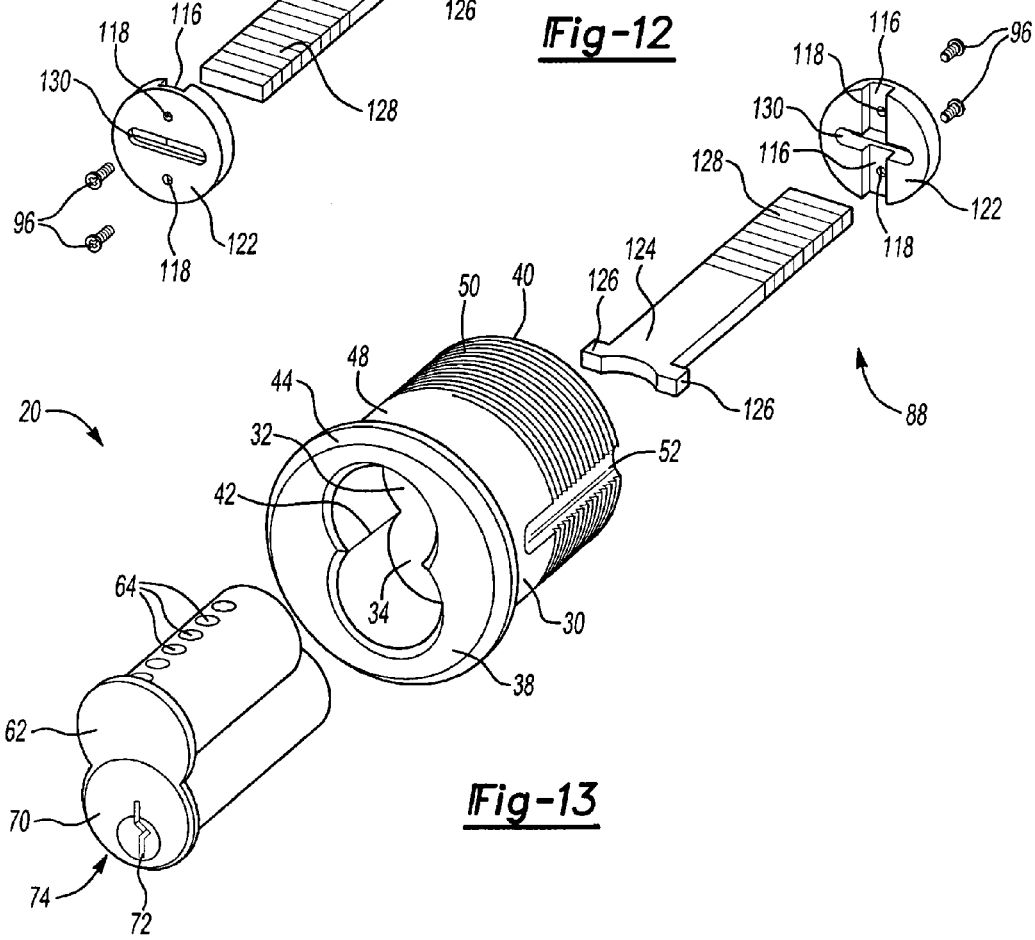
FIG. 13 is a perspective partial exploded front view of the lock assembly in the second lock configuration.
Figure 14:
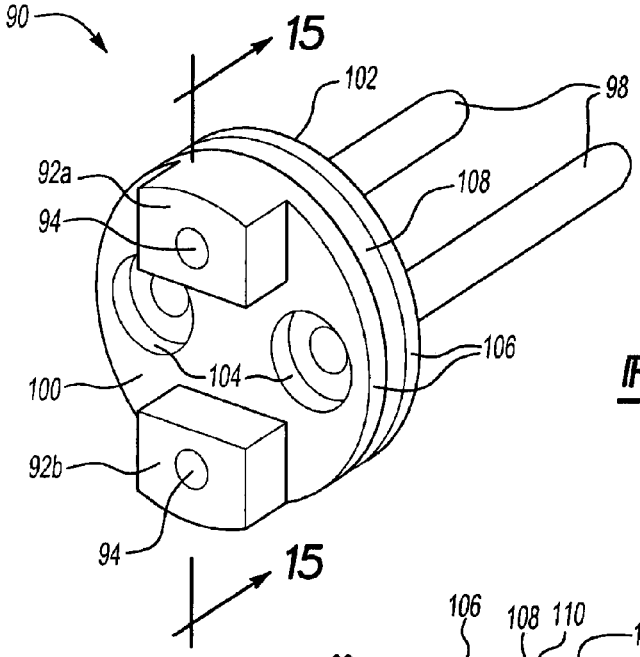
FIG. 14 is a perspective view of a universal drive member.
Figure 15:
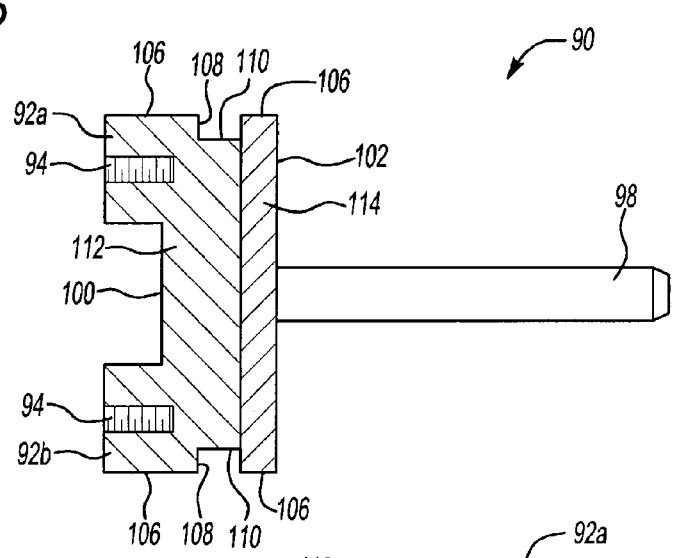
FIG. 15 is a cross-sectional side view of the universal drive member taken along line 15-15 of FIG. 14.
Figure 16:
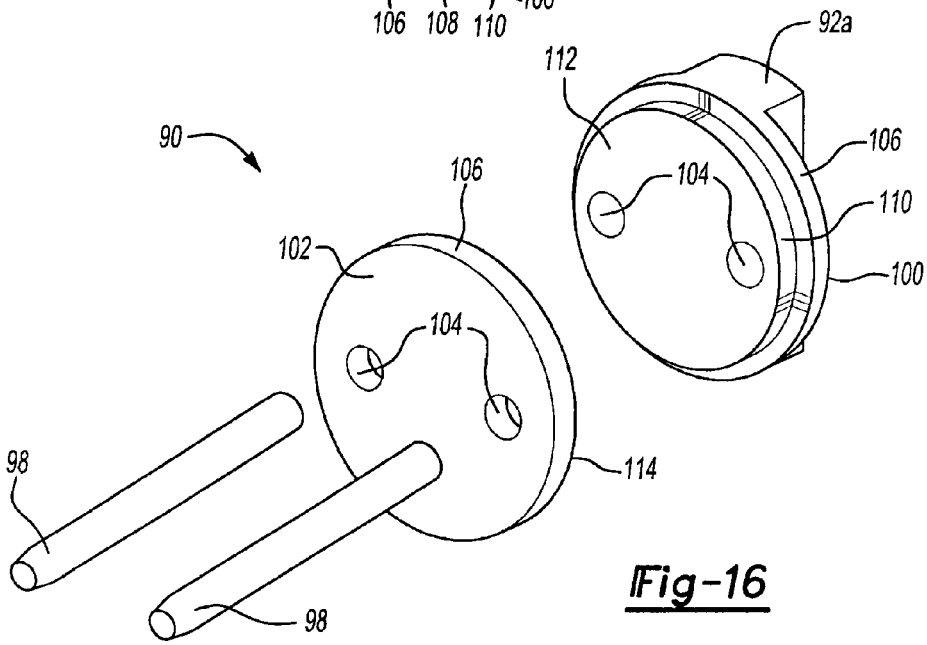
FIG. 16 is a perspective exploded view of the universal drive member.
Figure 17:
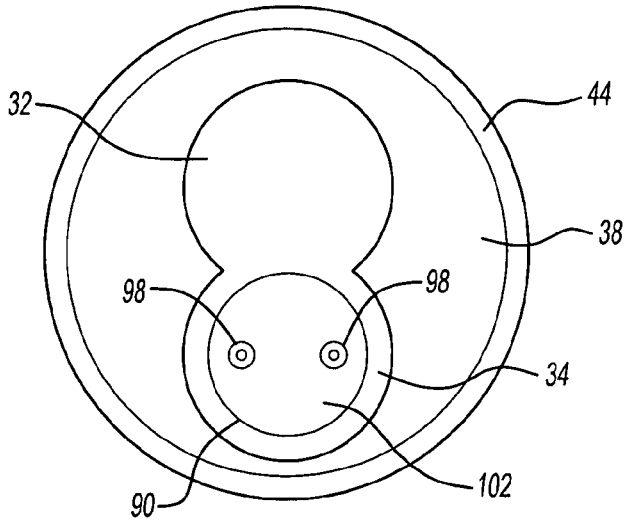
FIG. 17 is a front view of the housing with the core removed to show the universal drive member.
Figure 18:
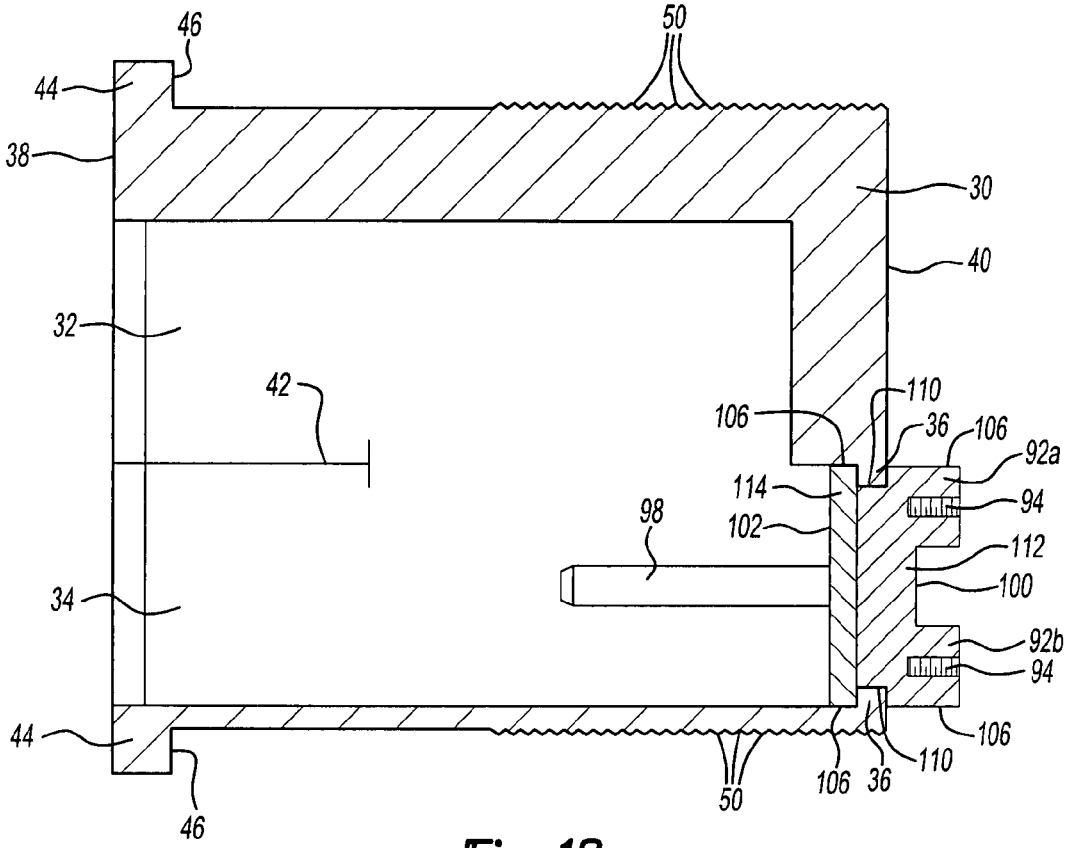
FIG. 18 is a cross-sectional view of the housing retaining the universal drive member.

Referring to FIGS. 8, 10, and 11, a first actuator 86 is coupled to the housing 30 for defining the first lock configuration and for engaging the arm 22 to retract the latch 24 to unlock the door 26. Referring to FIGS. 9, 12, and 13, a second actuator 88 is coupled to the housing 30 independently from the first actuator 86 for defining the second lock configuration and for engaging the arm 22 to retract the latch 24 to unlock the door 26. It is to be appreciated that the arm 22 is a generic term for the part or parts that are disposed between either the first actuator 86 and the latch 24 or the second actuator 88 and the latch 24 for locking and unlocking the door 26. The first and second actuators 86, 88 will be discussed in detail below.

Referring to FIGS. 14-18, a universal drive member 90 is coupled to the keyway 70 and movable with the keyway 70 between the locked and unlocked positions 74, 76 with the universal drive member 90 interchangeably receiving the first actuator 86 and the second actuator 88 while the keyway 70 remains in the core 62 for interchanging the lock assembly 20 between the first lock configuration and the second lock configuration. The lock assembly 20 provides a way to reduce inventory by eliminating the need for multiple drive members and multiple housings for each of the first and second lock configurations, which ultimately reduces costs. In addition, the universal drive member 90 is easily separable from the core 62 to easily change the core 62 with the second core without disassembling the lock assembly 20.

The universal drive member 90 includes at least one protrusion 92 for receiving at least one of the first actuator 86 and the second actuator 88. The at least one protrusion 92 is further defined as a first protrusion 92*a* and a second protrusion 92*b* with the first and second protrusions 92*a*, 92*b* each defining a hole 94. As shown in FIGS. 8-13, a fastener 96 is disposed in each of the holes 94 of the first and second protrusions 92*a*, 92*b* for securing at least one of the first and second actuators 86, 88 to the universal drive member 90. It is to be appreciated that the fastener 96 may be a screw, a bolt, a latch, or any other fastener known in the art to secure the first and second actuators 86, 88 to the universal drive member 90.

Referring back to FIGS. 14-18, the universal drive member 90 includes a plurality of posts 98 extending in an opposite direction from the first and second protrusions 92*a*, 92*b* for coupling the universal drive member 90 to the keyway 70. The orifices 78 of the keyway 70 receive the posts 98 to couple the universal drive member 90 to the keyway 70 when the universal drive member 90 rotates with the keyway 70 between the locked and unlocked positions 74, 76.

The universal drive member 90 further includes a first side 100 and a second side 102 opposing one another with the first and second protrusions 92*a*, 92*b* disposed on the first side 100 and the posts 98 disposed on the second side 102 and extending into the housing 30. The universal drive member 90 defines a plurality of openings 104 disposed through the first and second sides 100, 102 for receiving the posts 98. The first and second protrusions 92*a*, 92*b* are spaced from each other and spaced from the openings 104. The universal drive member 90 includes a periphery 106 with the first and second protrusions 92*a*, 92*b* disposed adjacent the periphery 106. The first and second protrusions 92*a*, 92*b* extend a predetermined distance away from the first side 100 of the universal drive member 90. More specifically, the first and second protrusions 92*a*, 92*b* extend transverse the periphery 106. Preferably, the first and second protrusions 92*a*, 92*b* are disposed between the periphery 106. The openings 104 of the universal drive member 90 are spaced from the periphery 106 and the first and second protrusions 92*a*, 92*b* such that the openings 104 are disposed between the first and second protrusions 92*a*, 92*b*.

The universal drive member 90 defines a groove 108 disposed between the first and second sides 100, 102 to define a recessed surface 110. More specifically, the groove 108 is disposed in the periphery 106 of the universal drive member 90. The flange 36 of the housing 30 is disposed in the groove 108 of the universal drive member 90 for retaining the universal drive member 90 to the housing 30. The second side 102 of the universal drive member 90 is disposed in the second chamber 34. More specifically, the second side 102 and the recessed surface 110 of the universal drive member 90 are disposed in the second chamber 34 with the second chamber 34 of the housing 30 complementary in configuration to the second side 102 and the recessed surface 110 of the universal drive member 90.

The universal drive member 90 includes the posts 98 and a first portion 112 having the first side 100, the first and second protrusions 92*a*, 92*b*, the recessed surface 110, the openings 104, and the periphery 106. The first portion 112 abuts the back side 40 of the housing 30 with the recessed surface 110 disposed in the second chamber 34 and abutting the flange 36. The universal drive member 90 further includes a plate 114 having the periphery 106 and the second side 102. The plate 114 abuts the first portion 112 and is spaced from the first side 100 of the first portion 112. Meaning the plate 114 is disposed adjacent the recessed surface 110. The plate 114 is disposed in the second chamber 34 and abuts the flange 36 with the second side 102 spaced from the flange 36. The posts 98 are disposed through the openings 104 in the plate 114 and disposed in the openings 104 of the first portion 112 to secure to the plate 114 to the first portion 112 and ultimately to retain the universal drive member 90 to the housing 30. Meaning the first portion 112 is coupled to the plate 114 by the posts 98. The posts 98 are disposed in the second chamber 34 of the housing 30 and pressed through the opening 104 of the plate 114 and pressed in the openings 104 of the first portion 112 for securing the plate 114 to the first portion 112. Meaning the posts 98 are press fit in the openings 104 of the plate 114 and the first portion 112. However, it is to be appreciated that the posts 98 may be secured to the first portion 112 by friction fit, interference fit, or any other method of attachment known in the art. The universal drive member 90 is retained to the housing 30 in such a way as to allow the universal drive member 90 to rotate freely relative to the housing 30.

Referring back to FIGS. 8-13, the first and second actuators 86, 88 each define a recess 116 complementary in configuration to the protrusion 92 for mounting at least one of the first and second actuators 86, 88 to the protrusion 92 to allow at least one of the first and second actuators 86, 88 to rotate with the universal drive member 90 when the keyway 70 rotates between the locked and unlocked positions 74, 76. More specifically, the recess 116 is complementary in configuration to the first and second protrusions 92*a*, 92*b*. The first and second actuators 86, 88 each define a plurality of voids 118 for receiving the fasteners 96 to secure at least one of the first and second actuators 86, 88 to the universal drive member 90. More specifically, the voids 118 are spaced from each other and disposed in the recess 116 and through each of the first and second actuators 86, 88.

The first actuator 86 includes an extension 120 spaced from the recess 116 for engaging the arm 22 to retract the latch 24 and unlock the door 26. The second actuator 88 includes a washer 122 defining the recess 116 and a tail member 124 extending from the washer 122. The tail member 124 includes a plurality of knobs 126 spaced from each other and coupled to the protrusion 92 with an elongated appendage 128 extending from the knobs 126 for engaging the arm 22 to retract the latch 24 and unlock the door 26. More specifically, the knobs 126 are disposed between the first and second protrusions 92*a*, 92*b*. The elongated appendage 128 of the tail member 124 is disposed through one of the cutouts 60 of the back plate 58. The cutout 60 of the back plate 58 allows the elongated appendage 128 to rotate freely without interference from the back plate 58. Preferably, the elongated appendage 128 is disposed between the rim fasteners 56. The washer 122 defines a passage 130 for receiving the elongated appendage 128 with the passage 130 extending transverse to the recess 116. More specifically, the passage 130 intersects the recess 116 of the washer 122.

Figure 19:
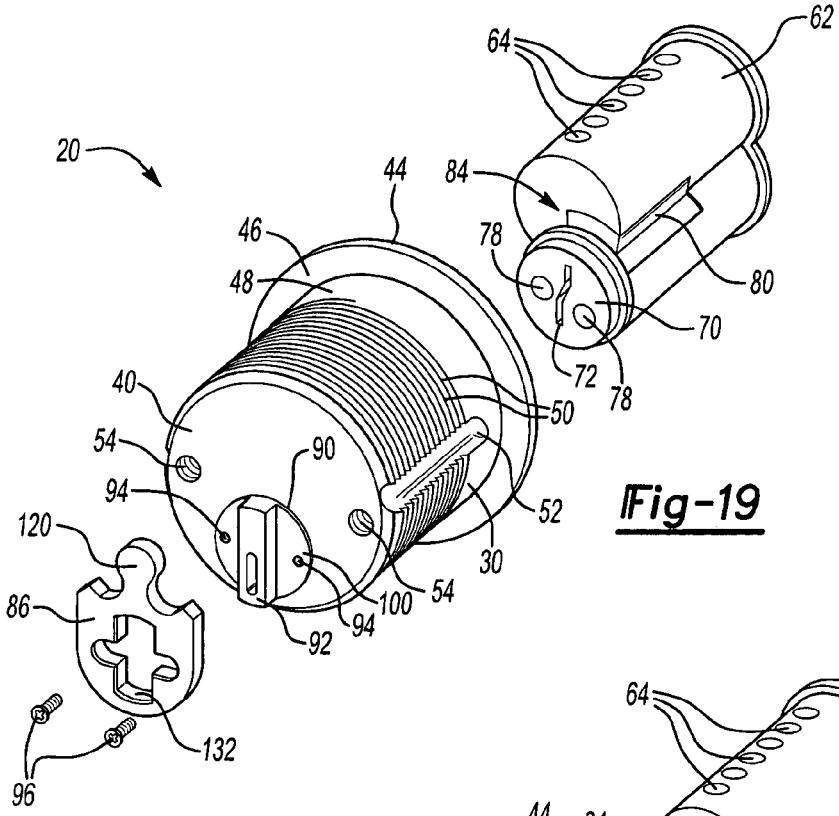
FIG. 19 is a perspective back view of the universal drive member in the first lock configuration of a second embodiment.
Figure 20:
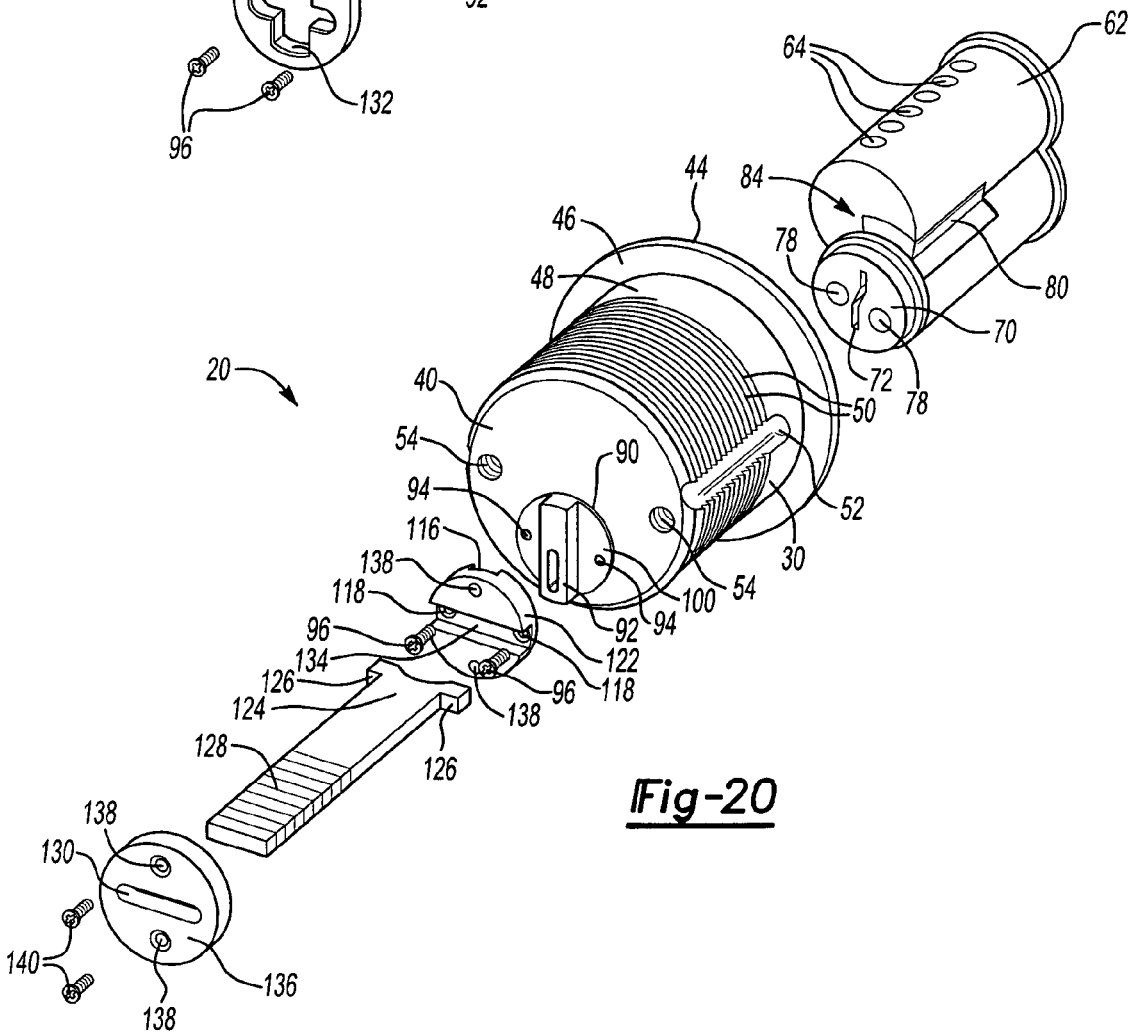
FIG. 20 is a perspective back view of the universal drive member in the second lock configuration of the second embodiment.

Referring to FIGS. 19 and 20, a second embodiment of the lock assembly 20 having the arm 22 coupled to the latch 24 for selectively locking and unlocking the door 26 using the key 28, wherein like numerals indicate like or corresponding parts throughout the several views, is generally shown. The primary distinction between the first embodiment and the second embodiment are the configurations of the universal drive member 90, the first actuator 86, the second actuator 88, and the protrusion 92. FIG. 19 shows the lock assembly 20 in the first lock configuration, which is commonly referred to as the mortise cylinder. FIG. 20 shows the lock assembly 20 in the second lock configuration, which is commonly referred to as the rim cylinder.

In this embodiment, the protrusion 92 is elongated and extends between the periphery 106 such that the second protrusion 92*b* is eliminated. The holes 94 are spaced from the protrusion 92 and are disposed in the first side 100 of the universal drive member 90. The first actuator 86 defines an aperture 132 complementary in configuration to the protrusion 92 for mounting the first actuator 86 to the protrusion 92 to allow the first actuator 86 to rotate with the universal drive member 90 when the keyway 70 rotates between the locked and unlocked positions 74, 76. More specifically, the aperture 132 is complementary in configuration to both the protrusion 92 and the fasteners 96.

The washer 122 of the second actuator 88 further defines a slit 134 transverse the recess 116 for receiving the tail member 124. The slit 134 is disposed on an opposite side from the recess 116 such that the slit 134 and the recess 116 do not intersect. The voids 118 are disposed in the slit 134 and through the washer 122. The fasteners 96 are disposed through the voids 118 and in the holes 94 of the universal drive member 90 for securing the washer 122 to the universal drive member 90. More specifically, the slit 134 of the washer 122 receives the knobs 126 of the tail member 124. The washer 122 further includes a backing 136 mounted to the washer 122 and defining the passage 130 for receiving the tail member 124. The slit 134 of the washer 122 and the passage 130 of the backing 136 are parallel to each other. The backing 136 and the washer 122 each define a plurality of hollows 138 with the hollows 138 of the backing 136 parallel to the hollows 138 of the washer 122 for securing the backing 136 to the washer 122 using a plurality of screws 140. However, it is to be appreciated that the backing 136 may be secured to the washer 122 in any acceptable method of attachment known in the art. The hollows 138 of the backing 136 are spaced from the passage 130 of the backing 136. In addition, the hollows 138 of the washer 122 are spaced from the voids 118 of the washer 122. More specifically, the hollows 138 are spaced from the slit 134 of the washer 122.

Below is a discussion of using the lock assembly 20 to lock and unlock the door 26 and will assume, for illustration purposes only, that the lock assembly 20 is mounted to the door 26 in the first lock configuration. The key 28 is inserted in the slot 72 of the keyway 70 while in the locked position 74, which cause the pins 66 and springs 68 within the core 62 move to the appropriate position to allow the keyway 70 to turn. The keyway 70 rotates when the key 28 moves from the lock position to the unlocked position 76, which rotates the posts 98 and the universal drive member 90. Rotation of the universal drive member 90 causes the first actuator 86 to rotate and engage the arm 22 which retracts the latch 24 to unlock the door 26. To lock the door 26, the key 28 is rotated back from the unlocked position 76 to the locked position 74 which rotates the first actuator 86, the universal drive member 90, and the keyway 70 back to the locked position 74.

Below is a discussion of the differences between the mortise cylinder and the rim cylinder. The first lock configuration is shown in FIGS. 8, 10, and 11, and is commonly referred to as the mortise cylinder. The mortise cylinder includes the first actuator 86 and the threads 50 disposed on the body portion 48 of the housing 30. The mortise cylinder is coupled to the door 26 by threading the housing 30 into the door 26 by the threads 50 disposed on the body portion 48. The face plate 44 of the housing 30 abuts one side of the door 26 with the housing 30 extending a predetermined distance into the door 26. Meaning the mortise cylinder does not extend completely through both sides of the door 26. The first actuator 86 for the mortise cylinder is coupled to the universal drive member 90 in such a way as to allow the first actuator 86 to rotate and engage the arm 22 to retract the latch 24 and unlock the door 26.

The second lock configuration is shown in FIGS. 9, 12, and 13, and is commonly referred to as the rim cylinder. The rim cylinder includes the second actuator 88, the back plate 58, and the rim fasteners 56. The rim cylinder is coupled to the door 26 by the rim fasteners 56 and the back plate 58. Meaning the rim cylinder is disposed completely through the door 26 such that the back plate 58 is disposed on one side of the door 26 and the face plate 44 of the housing 30 is disposed on the other side of the door 26. The second actuator 88 for the rim cylinder is coupled to the universal drive member 90 in such a way as to allow the second actuator 88 to rotate and engage the arm 22 to retract the latch 24 and unlock the door 26.

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A lock assembly having an arm coupled to a latch for selectively locking and unlocking a door using a key, said assembly comprising:

a housing having threads for mounting said housing to the door in a mortise configuration and said housing defining a plurality of blind holes for mounting said housing to the door in a rim configuration;

a first actuator coupled to said housing for engaging the arm to retract the latch to unlock the door with said first actuator utilized in said mortise configuration;

a second actuator coupled to said housing independently from said first actuator for engaging the arm to retract the latch to unlock the door with said second actuator utilized in said rim configuration;

a core removably disposed in said housing, said core comprising one of a first core and a second core each removably disposed in said housing such that said first core is interchangeable and replaceable with said second core and said cores having a keyway defining a slot for receiving the key, said keyway and said slot being rotatable within respective cores between a locked position and an unlocked position; and a universal drive member rotatably fixed to said housing independently of said first and second actuators with said keyway of said cores selectively coupled to said universal drive member such that said first core is interchangeable with said second core and removable from said housing independently of said universal drive member with said first and second actuators independently removable from said universal drive member with said keyway and said universal drive member movable together between said locked and unlocked positions when coupled together and said universal drive member interchangeably receives said first and second actuators while one of said first and second cores remain coupled to said universal drive member for interchanging said mortise and rim configurations.

2. An assembly as set forth in claim 1 wherein said universal drive member includes at least one protrusion for receiving at least one of said first actuator and said second actuator.

3. An assembly as set forth in claim 2 wherein said at least one protrusion is further defined as a first protrusion and a second protrusion.

4. An assembly as set forth in claim 3 wherein said universal drive member includes a plurality of posts extending in an opposite direction from said first and second protrusions for coupling said universal drive member to said keyway.

5. An assembly as set forth in claim 4 wherein said universal drive member includes a first side and a second side opposing one another with said first and second protrusions disposed on said first side and said posts disposed on said second side and extending into said housing.

6. An assembly as set forth in claim 5 wherein said universal drive member defines a groove disposed between said first and second sides to define a recessed surface.

7. An assembly as set forth in claim 6 wherein said housing defines a first chamber and a second chamber adjacent one another for receiving said cores and said second side of said universal drive member.

8. An assembly as set forth in claim 7 wherein said housing includes a flange extending into said second chamber with said flange disposed in said groove of said universal drive member for retaining said universal drive member to said housing.

9. An assembly as set forth in claim 7 wherein said housing includes a front side and a back side with said first chamber open to said front side and closed to said back side and complementary in configuration to said cores and said second chamber open to both said front and back sides and complementary in configuration to said cores and said second side of said universal drive member and said recessed surface of said universal drive member.

10. An assembly as set forth in claim 4 wherein said keyway defines a plurality of orifices and said slot disposed between said orifices for receiving the key with said orifices receiving said posts to couple said universal drive member to said keyway such that said universal drive member rotates with said keyway between said locked and unlocked positions.

11. An assembly as set forth in claim 3 wherein said first and second protrusions each define a hole.

12. An assembly as set forth in claim 11 further including a fastener disposed in each of said holes of said first and second protrusions for securing at least one of said first and second actuators to said universal drive member.

13. An assembly as set forth in claim 2 wherein said first and second actuators each define a recess complementary in configuration to said protrusion for mounting at least one of said first and second actuators to said protrusion to allow at least one of said first and second actuators to rotate with said universal drive member when said keyway rotates between said locked and unlocked positions.

14. An assembly as set forth in claim 13 wherein said first actuator includes an extension spaced from said recess for engaging the arm to retract the latch and unlock the door.

15. An assembly as set forth in claim 13 wherein said second actuator includes a washer defining said recess and a tail member extending from said washer.

16. An assembly as set forth in claim 15 wherein said tail member includes a plurality of knobs spaced from each other and coupled to said protrusion with an elongated appendage extending from said knobs for engaging the arm to retract the latch and unlock the door.

17. An assembly as set forth in claim 16 wherein said washer further defines a passage for receiving said elongated appendage with said passage extending transverse to said recess.

18. An assembly as set forth in claim 16 wherein said washer further defines a slit transverse said recess for receiving said tail member.

19. An assembly as set forth in claim 2 wherein said first actuator defines an aperture complementary in configuration to said protrusion for mounting said first actuator to said protrusion to allow said first actuator to rotate with said universal drive member when said keyway rotates between said locked and unlocked positions.

20. An assembly as set forth in claim 1 wherein said cores define a plurality of bores spaced from each other and having a plurality of pins disposed in each of said bores and a plurality of springs with at least one of said springs disposed in each of said bores and abutting at least one of said pins.

21. An assembly as set forth in claim 1 wherein said universal drive member is attached to either said first actuator or said second actuator such that either said first and second actuators rotate with said universal drive member.

22. An assembly as set forth in claim 21 wherein said housing, said first actuator, said cores and said universal drive member accommodates said mortise configuration.

23. An assembly as set forth in claim 21 further including a back plate coupled to said housing utilizing said blind holes and wherein said housing, said back plate, said second actuator, said cores and said universal drive member accommodates said rim configuration.

* * * * *